United States Patent [19]

Sakaguchi

[11] Patent Number: 4,639,414

[45] Date of Patent: Jan. 27, 1987

[54] HEAT DEVELOPABLE LIGHT-SENSITIVE MATERIAL

[75] Inventor: Yukihiko Sakaguchi, Kanagawa, Japan

[73] Assignee: Fuji Photo Film Co., Ltd., Kanagawa, Japan

[21] Appl. No.: 744,369

[22] Filed: Jun. 13, 1985

[30] Foreign Application Priority Data

Jun. 13, 1984 [JP] Japan ..... 59-120039

[51] Int. Cl.[4] ..... G03C 1/02

[52] U.S. Cl. ..... 430/550; 430/599; 430/617; 430/619; 430/620; 430/569; 430/570; 430/581; 430/580; 430/592; 430/203; 430/603; 430/605; 430/351; 430/353

[58] Field of Search ..... 430/599, 617, 619, 620, 430/569, 570, 581, 580, 592, 203, 550, 542, 603, 605, 351, 353, 341, 343

[56] References Cited

U.S. PATENT DOCUMENTS

| | | | |
|---|---|---|---|
| 4,225,666 | 9/1980 | Locker et al. | 430/570 |
| 4,435,499 | 3/1984 | Reeves | 430/350 |
| 4,476,220 | 10/1984 | Penfound | 430/570 |

OTHER PUBLICATIONS

Research Disclosure 17029, Jun. 1978.

*Primary Examiner*—Won H. Louie

*Attorney, Agent, or Firm*—Sughrue, Mion, Zinn, Macpeak and Seas

[57] ABSTRACT

A heat developable light-sensitive material comprising a support having thereon (1) a light-sensitive silver halide emulsion, (2) at least one of a base and a base precursor, and (3) a binder, wherein the silver halide emulsion is one which is chemically sensitized in the presence of a sensitizing dye. With the heat developable light-sensitive material, decrease in sensitivity and formation of fog during preservation thereof are prevented.

22 Claims, No Drawings

HEAT DEVELOPABLE LIGHT-SENSITIVE MATERIAL

FIELD OF THE INVENTION

The present invention relates to a heat developable light-sensitive material. More particularly, the present invention relates to a heat developable light-sensitive material using silver halide.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for light-sensitive materials using silver halide, many techniques capable of easily and quickly obtaining images have been developed by changing the conventional wet process using a developing solution into a dry development process such as a process using heat, etc.

Heat developable light-sensitive materials are known in the field of these techniques. Heat developable light-sensitive materials and processes therefor have been described, for example, in *Shashin Kogaku no Kiso* (The Foundation of Photographic Technology), pages 553 to 555 (published by Corona Co., 1979), *Eizo Jyoho,* page 40 (April, 1978), *Nebletts Handbook of Photography and Reprography,* 7th Ed., pages 32 to 33 (Van Nostrand Reinhold Company), U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure* No. 137 (RD-13742), pages 31 and 32 (September, 1975) and the combination of a sulfonamidophenol type reducing agent and a 4-equivalent coupler as described in U.S. Pat. No. 4,021,240.

Also, processes for forming a positive color image by a light-sensitive silver dye bleach process, with useful dyes and methods for bleaching have been described, for example, in *Research Disclosure,* No. 14433, pages 30 to 32 (April, 1976), ibid., No. 15227, pages 14 and 15 (December, 1976) and U.S. Pat. No. 4,235,957, etc.

Further, processes for forming images upon heat development utilizing compounds originally having a dye moiety and capable of releasing a mobile dye in correspondence or counter-correspondence to the reduction reaction of silver halide to silver under conditions of high temperature have been described, for example, in European Patent Applications 76,492A and 79,056A, Japanese Patent Application (OPI) Nos. 28928/83 and 26008/83, etc.

In such image forming processes, it is usual for a base or base precursor to be present in a light-sensitive material at the time of heating for the purpose of accelerating development. However, an attempt to combine a base or a base precursor and a silver halide emulsion spectrally sensitized with a sensitizing dye in a light-sensitive material has suffered from the defect that a decrease in sensitivity occurs during preservation prior to use. Therefore, it is generally not easy to improve the developing property and preservability prior to use while maintaining the sensitivity of the light-sensitive material.

The inventors have previously found that the above-described defect can be eliminated by employing a silver halide emulsion which comprises silver halide grains prepared in the presence of a sensitizing dye as described in U.S. patent application Ser. No. 697,988. However, since this method has a tendency to increase in fog, further improvement has been desired.

SUMMARY OF THE INVENTION

An object of the present invention is to provide a heat developable light-sensitive material containing both a base and/or a base precursor and a silver halide emulsion spectrally sensitized with a sensitizing dye which material is excellent in preservability and in which formation of fog is prevented.

Another object of the present invention is to provide a method by which improvement in preservability and prevention of fog formation are simultaneously achieved in a heat developable light-sensitive material containing a base and/or a base precursor for the purpose of accelerating development at the time of heating.

Other objects of the present invention will become apparent from the following detailed description and examples.

The above-described objects of the present invention can be attained with a heat developable light-sensitive material comprising a support having thereon (1) a light-sensitive silver halide emulsion, (2) at least one of a base and a base precursor, and (3) a binder, wherein the silver halide emulsion is one which is chemically sensitized in the presence of a sensitizing dye.

DETAILED DESCRIPTION OF THE INVENTION

The surface and/or interior of silver halide grains in the silver halide emulsion used in the present invention can be subjected to chemical sensitization. The chemical sensitization can be carried out at the chemical ripening step which comprises dissolving a silver halide emulsion after removal of soluble salts by adding a necessary amount of water and gelatin, etc., thereto adjusting the pH and the pAg thereof, adding a sensitizer and a restrainer, etc. thereto and then heating the emulsion at a temperature of 50° C. to 60° C. for a period of 30 to 90 minutes. Since the excessive soluble salts have been removed by desalting, the growth of crystals does not occur during the chemical ripening step but light-sensitive nuclei are formed on the surface of silver halide grains by means of the sensitizers added, etc., and as a result sensitivity and gradation of the silver halide emulsion are increased.

For the purpose of chemical sensitization, the methods as described in, e.g., H. Frieser, *Die Grundlagen der Phtographischen Prozesse mit Silberhalogeniden,* pages 675 to 734, Akademische Verlagsgesellschaft (1968) can be employed.

More specifically, a sulfur sensitization method using active gelatin or compounds containing sulfur capable of reacting with silver (e.g., thiosulfates, thioureas, mercapto compounds, rhodanines, etc.); a sensitization method using compounds containing selenium or tellurium, etc; a reduction sensitization method using reducing materials (e.g., stannous salts, amines, hydrazine derivatives, formamidinesulfinic acid, silane compounds, etc.); a noble metal sensitization method using noble metal compounds (e.g., gold complex salts, and complex salts of the Group VIII metals in the Periodic Table such as Pt, Ir, Pd, etc.); and the like can be employed individually or as a combination thereof.

Specific examples of sulfur sensitization methods are described in U.S. Pat. Nos. 1,574,944, 2,410,689, 2,278,947, 2,728,668 and 3,656,955, etc. Specific examples of sensitization methods using compounds containing selenium or tellurium are described in *Research Disclosure,* No. 176 (RD-17643), Chapter III (December, 1978). Specific examples of reduction sensitization methods are described in U.S. Pat. Nos. 2,983,609, 2,419,974 and 4,054,458, etc. Specific examples of noble metal sensitization methods are described in U.S. Pat. Nos. 2,399,083 and 2,448,060, British Pat. No. 618,061, etc.

Further, in order to apply surface chemical sensitization to internal latent image type silver halide grains, the methods as described in Japanese Patent Publication No. 34213/77, etc. can be utilized. Also, in case of core/shell type internal latent image emulsions the surface chemical sensitization method which is carried out in the presence of the specific polymer as described in Japanese Patent Application (OPI) No. 136641/82 can be applied (the term "OPI" as used herein means a "published unexamined Japanese patent application").

Spectral sensitization is usually carried out using one or more methine dyes as a sensitizing dye. Suitable examples of methine dyes which can be employed include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes, and complex merocyanine dyes. any nuclei usually present in cyanine dyes can be used as the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline, and like nuclei. Each of these nuclei may be substituted on the carbon atom(s) thereof.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

Specific examples of sensitizing dyes which are useful in the present invention include dyes having the following general formulae (A) to (H), (J) to (U), (W) and (Y), respectively.

Formula (A)

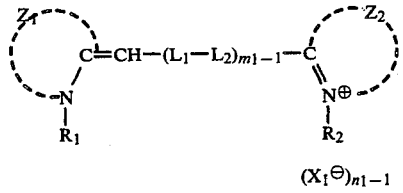

In formula (A), $Z_1$ and $Z_2$ each represents atoms to complete a heterocyclic nucleus of the type usually present in cyanine dyes, such as thiazole, thiazoline, benzothiazole, naphthothiazole, oxazole, oxazoline, benzoxazole, naphthoxazole, tetrazole, pyridine, quinoline, imidazoline, imidazole, benzimidazole, naphthoimidazole, selenazoline, selenazole, benzoselenazole, naphthoselenazole, indolenine, or like nucleus. These nuclei each may be substituted with a lower alkyl group like methyl, a halogen atom, a phenyl group, a hydroxyl group, an alkoxy group containing from 1 to 4 carbon atoms, a carboxyl group, an alkoxycarbonyl group, an alkylsulfamoyl group, an alkylcarbomoyl group, an acetyl group, an acetoxy group, a cyano group, a trichloromethyl group, a trifluoromethyl group, a nitro group, and so on.

$L_1$ and $L_2$ each represents a methine group or a substituted methine group. Suitable substituted methine groups include those substituted with a lower alkyl group like methyl, ethyl, etc., a phenyl group, a substituted phenyl group, a methoxy group, an ethoxy group, and so on.

$R_1$ and $R_2$ each represents an alkyl group containing from 1 to 5 carbon atoms, a substituted alkyl group having a carboxyl group, a substituted alkyl group having a sulfo group such as γ-sulfopropyl, δ-sulfobutyl, 2-(3-sulfopropoxy)ethyl, 2-[2-(3-sulfopropoxy)ethoxy]ethyl, 2-hydroxy sulfopropyl, etc., an allyl group or other substituted alkyl group of the type which is usually employed as a group to be substituted at the nitrogen position of cyanine dyes. $m_1$ represents 1, 2 or 3. $X_1\ominus$ represents an acid anion group of the type conventionally employed for cyanine dyes, such as iodine ion, bromine ion, p-toluenesulfonic acid ion, perchloric acid ion, or so on. $n_1$ represents 1 or 3, and $n_1$ is 1 when the dye has a betaine structure.

Formula (B)

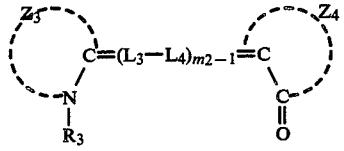

In formula (B), $Z_3$ represents a heterocyclic nucleus of the type usually present in cyanine dyes, as described above for formula (A). $Z_4$ represents atoms forming a ketohetero nucleus of the type which is usually present in merocyanine dyes, with specific examples including rhodanine, thiohydantoin, oxyindole, 2-thioxazolidinedione, 1,3-indanedione and like nuclei. $L_3$ and $L_4$ have the same meanings as $L_1$ and $L_2$ in formula (A), respectively. $R_3$ has the same meaning as $R_1$ or $R_2$ in formula (A). $m_2$ represents 1, 2, 3 or 4.

Formula (C)

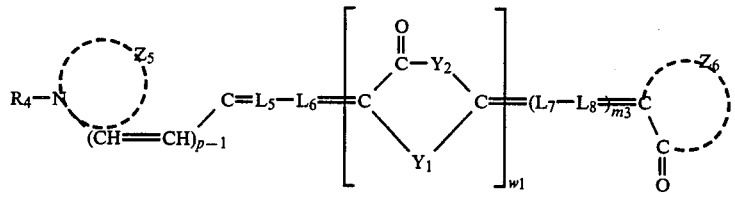

In formula (C), $Z_5$ represents atoms completing a 4-quinoline nucleus, a 2-quinoline nucleus, a benzothiazole nucleus, a benzoxazole nucleus, a naphthothiazole nucleus, a naphthoselenazole nucleus, a naphthoxazole nucleus, a benzoselenazole nucleus or an indolenine nucleus. $p_1$ represents 0 or 1. $R_4$ has the same meaning as $R_1$ or $R_2$ (in formula (A)), and $L_5$ and $L_6$ have the same meanings as $L_3$ and $L_4$ (in formula (B)), respectively. $m_3$ represents 0 or 2. $L_7$ and $L_8$ have the same meanings as $L_1$ and $L_2$ (in formula (A)), respectively. $Z_6$ has the same meaning as $Z_4$ (in formula (B)). $Y_1$ and $Y_2$ represent an oxygen atom, a sulfur atom, a selenium atom or a group of the formula $=N-R_5$ (wherein $R_5$ represents an alkyl group containing not more than 8 carbon atoms such as methyl, ethyl, propyl, etc., or an allyl group), provided that at least either $Y_1$ or $Y_2$ represents $=N-R_5$. $W_1$ represents 1 or 2.

Formula (D)

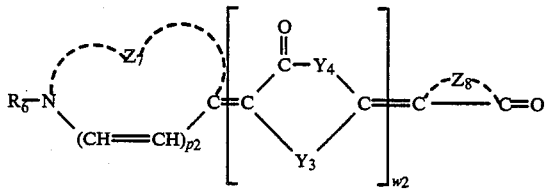

In formula (D), $Z_7$, $Z_8$, $R_6$ and $p_2$ have the same meanings as $Z_5$, $Z_6$, $R_1$ or $R_2$, and $p_1$ (as described above), respectively. $Y_3$ and $Y_4$ have the same meanings as $Y_1$ and $Y_2$ (in formula (C)), respectively. $W_2$ has the same meaning as $W_1$ (in formula (C)).

Formula (E)

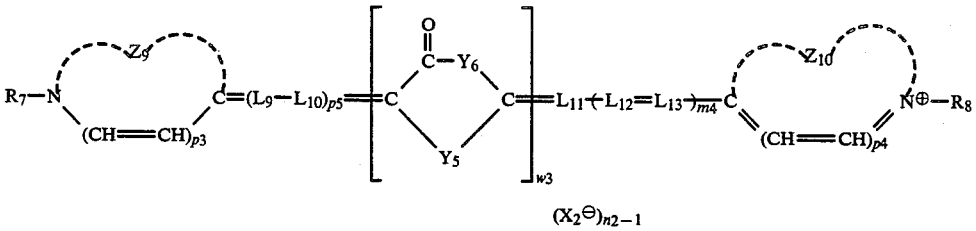

In the above formula (E), $R_7$ and $R_8$ have the same meanings as $R_1$ described above, $Z_9$ and $Z_{10}$ have the same meaning as $Z_5$ described above, $p_3$ and $p_4$ have the same meaning as $p_1$ described above, $L_9$ to $L_{13}$ have the same meanings as $L_1$ described above, $X_2^{\ominus}$ has the same meaning as $X_1^{\ominus}$ described above, and $n_2$ has the same meaning as $n_1$ described above. $Y_5$ and $Y_6$ have the same meaning as $Y_1$ described above. $p_5$ and $m_4$ each represents 0 or 1. $W_3$ has the same meaning as $W_1$ described above.

Formula (F)

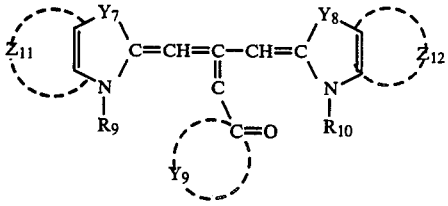

In formula (F), $Z_{11}$ and $Z_{12}$ each represents atoms completing an unsubstituted benzene ring or a substituted benzene ring, especially one which is substituted with a lower alkyl group like methyl, a halogen atom, a phenyl group, a hydroxyl group, an alkoxyl group containing from 1 to 4 carbon atoms, a carboxyl group, an alkoxycarbonyl group, an alkylsulfamoyl group, an alkylcarbamoyl group, an acetyl group, a cyano group, a trichloromethyl group, a trifluoromethyl group, a nitro group, etc., or atoms completing a naphthalene ring. $R_9$ and $R_{10}$ have the same meaning as $R_1$ (as described above). $Y_7$ and $Y_8$ each represents an oxygen atom, a sulfur atom, a selenium atom,

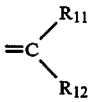

wherein $R_{11}$ and $R_{12}$ each represents a methyl group or an ethyl group), $=N-R_{13}$ (wherein $R_{13}$ represents an unsubstituted alkyl group, a substituted alkyl group which has conventionally been employed as a substituent group present at the nitrogen-position of a cyanine dyes, or an allyl group), or —CH=CH—. $Y_9$ represents atoms forming a 5- or 6-membered heterocyclic ring.

Formula (G)

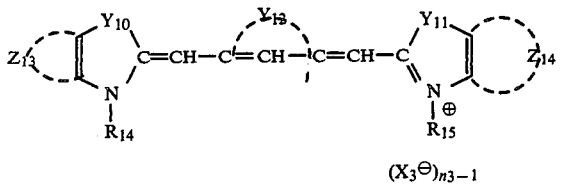

In formula (G), $Z_{13}$ and $Z_{14}$ each, $R_{14}$ and $R_{15}$ each, and $Y_{10}$ and $Y_{11}$ each have the same meanings as $Z_{11}$, $R_1$, and $Y_7$, respectively. $Y_{12}$ represents atoms forming a 5- or 6-membered carbon ring. $X_3\ominus$ and $n_3$ have the same meanings as $X_1\ominus$ and $n_1$, respectively.

Formula (H)

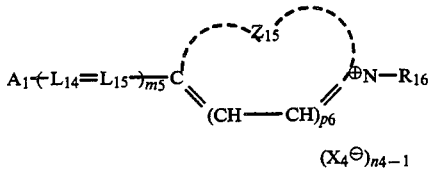

Formula (J)

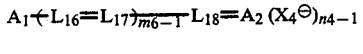

In the above formula (H) and (J), $X_4\ominus$ and $n_4$ have the same meaning as $X_1\ominus$ and $n_1$, respectively. $P_6$ represents 0 or 1, and $m_5$ and $m_6$ each represents 1 or 2. $L_{14}$ through $L_{18}$ have the same meaning as $L_1$. $Z_{15}$ has the same meaning as $Z_1$. $n_4$ has the same meaning as $n_1$. $A_1$ and $A_2$ each represents atoms to complete a heterocyclic nucleus of the type usually present in cyanine dyes. Preferable groups represented by $A_1$ include

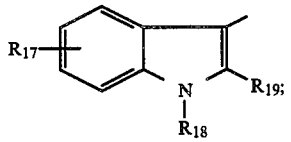

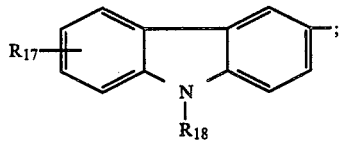

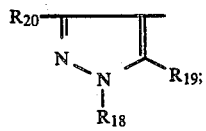

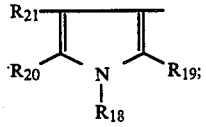

-continued

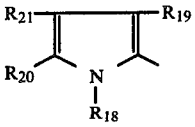

and

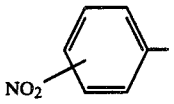

Preferable groups represented by $A_2$ include

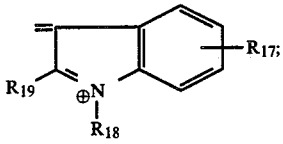

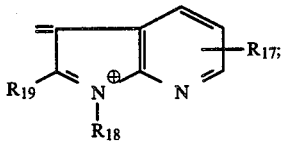

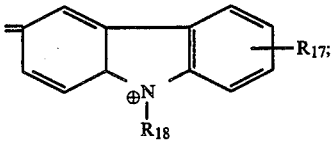

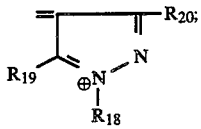

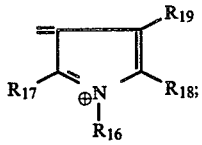

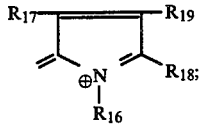

and

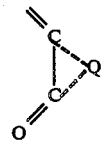

Therein, $R_{16}$ and $R_{18}$ each represents a hydrogen atom, an alkyl group, a substituted alkyl group, or an aryl group. $R_{17}$ represents a halogen atom, a nitro group, a lower alkyl group, an alkoxy group, an alkoxycarbonyl group, an alkylsulfonyl group, or an arylsulfonyl group. $R_{19}$, $R_{20}$, and $R_{21}$ each represents a hydrogen atom, a halogen atom, an alkyl group, a cycloalkyl group, an aryl group, a pyridyl group, a carboxyl group, or an alkoxycarbonyl group. Q represents atoms completing a 5- or 6-membered heterocyclic nucleus such as rhodanine, 2-thioxazolidinedione, 2-thiohydantoin, barbituric acid and so on.

Formula (K)

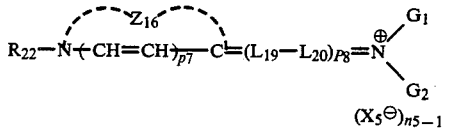

In formula (K), $R_{22}$, $Z_{16}$, and $L_{19}$ and $L_{20}$ each has the same meanings as $R_1$, $Z_1$, and $L_1$, respectively. $p_7$ represents 0 or 1, and $p_8$ represents 1, 2 or b 3. $G_1$ and $G_2$ may be the same or different, and they each may have the same meanings as $R_1$, or the combination thereof can represent atoms forming a cyclic secondary amine (e.g., pyrrolidone, 3-pyrroline, piperidine, piperazine, morpholine, 1,2,3,4-tetrahydroquinoline, decahydroquinoline, 3-azabicyclo[3,2,2]nonane, iodoline, azetine and hexahydroazepine). $X_5^{\ominus}$ and $n_5$ have the same meanings as $X_1^{\ominus}$ and $n_1$, respectively.

Formula (L)

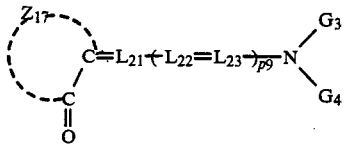

In formula (L), $Z_{17}$ has the same meaning as $Z_4$. $L_{21}$, $L_{22}$ and $L_{23}$ each has the same meaning as $L_1$, and $G_3$ and $G_4$ each has the same meaning as $G_1$ and $G_2$. $p_9$ represents 0, 1, 2, or 3.

Particularly useful dyes for imparting infrared sensitivity to silver halide grains are those represented by the following formulae (M) to (U), (W) and (Y).

Formula (M)

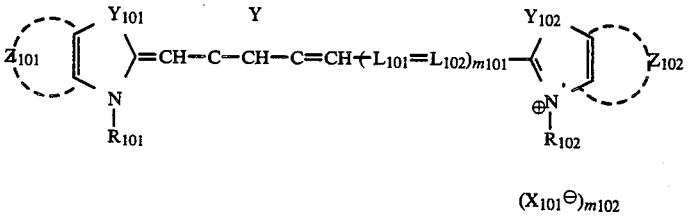

In formula (M), $R_{101}$ and $R_{102}$ may be the same or different, and they each represents an alkyl group (preferably those having from 1 to 8 carbon atoms, such as methyl, ethyl, propyl, butyl, pentyl, heptyl, etc.) or a substituted alkyl group, the alkyl moiety of which has not more than 6 carbon atoms and is substituted with one or more of a group selected from among carboxyl, sulfo, cyano, halogen (e.g., fluorine, chlorine, bromine, etc.), hydroxy, alkoxycarbonyl (those having not more than 8 carbon atoms, such as methoxycarbonyl, ethoxycarbonyl, benzyloxycarbonyl, etc.), an alkoxy (those having not more than 7 carbon atoms, such as methoxy, ethoxy, propoxy, butoxy, benzyloxy, etc.), aryloxy (e.g., phenoxy, p-tolyloxy, etc.), acyloxy (those having not more than 3 carbon atoms, such as acetyloxy, propionyloxy, etc.), acyl (those having not more than 8 carbon atoms, such as acetyl propionyl, benzoyl, mesyl, etc.), carbamoyl (e.g., carbamoyl, N,N-dimethylcarbamoyl, morpholinocarbamoyl, piperidinocarbamoyl, etc.), sulfamoyl (e.g., sulfamoyl, N,N-dimethylsulfamoyl, morpholinosulfamoyl, etc.), aryl (e.g., phenyl, p-hydroxyphenyl, p-carboxyphenyl, p-sulfophenyl, α-naphthyl, etc.) and so on.

In the foregoing formula (M), $Y_{101}$ and $Y_{102}$ each represents an oxygen atom, a sulfur atom, a selenium atom,

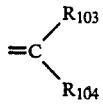

(wherein $R_{103}$ and $R_{104}$ each represents a methyl group or an ethyl group), =N—$R_{105}$ [wherein $R_{105}$ represents an unsubstituted or substituted alkyl group containing not more than 5 carbon atoms (which can include a substituent group, e.g., hydroxyl, halogen, carboxyl, sulfo, alkoxy or so on), or an allyl group] or —CH=CH—.

In the foregoing formula (M), $Z_{101}$ and $Z_{102}$ each represents atoms necessary to form a substituted or unsubstituted benzene or naphthalene ring. Suitable examples of substituent groups which those rings may have include lower alkyl groups like methyl, halogen atoms, phenyl groups, hydroxyl groups, alkoxy groups containing from 1 to 4 carbon atoms, carboxyl groups, alkoxycarbonyl groups, alkylsulfamoyl groups, alkylcarbamoyl groups, acyl groups, cyano groups, trifluoromethyl groups, nitro groups, and so on.

Specific examples of nitrogen-containing hetero rings formed by fusing together a $Y_{101}$-containing ring and $Z_{101}$, or a $Y_{102}$-containing ring and $Z_{102}$ include thiazole nuclei (such as benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-methyl-6-methoxybenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphthol[1,2-d]thiazole, 7-ethoxynaphtho[2,1-d]thiazole, 8-methoxynaphtho[2,1-d]thiazole, 5-methoxynaphtho[2,3-d]thiazole, etc.), selenazole nuclei (such as benzoselenazole, 5-chlorobenzoselenazole, 5-methoxybenzoselenazole, 5-hydroxybenzoselenazole, naphtho[2,1-d]selenazole, naphtho[1,2-d]selenazole, etc.), oxazole nuclei (such as benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole, etc.), quinoline nuclei (such as 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline, etc.), 3,3-dialkylindolenine nuclei (such as 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.), imidazole nuclei (such as 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole, etc.), and so on.

In the foregoing formula (M), Y represents atoms necessary to form a 5- or 6-membered carbon ring, or represents a methine chain when it does not form any ring.

In the foregoing formula (M), $m_{101}$ represents 1 or 2, $X_{101}$ represents an acid residue, and $m_{102}$ represents 0 or 1, and $m_{102}$ is 0 when the dye has a betaine structure.

$L_{101}$ and $L_{102}$ each represents a methine group or a substituted methine group. Specific examples of substituted methine groups include those substituted with a lower alkyl group containing from 1 to 5 carbon atoms, a lower alkoxy group, an aryl group (which may be substituted with a halogen atom, an alkyl group containing from 1 to 4 carbon atoms, an alkoxy group containing from 1 to 4 carbon atoms, a sulfo group, a carboxyl group, and so on), an aralkyl group (such as benzyl), and so on.

Formula (N)

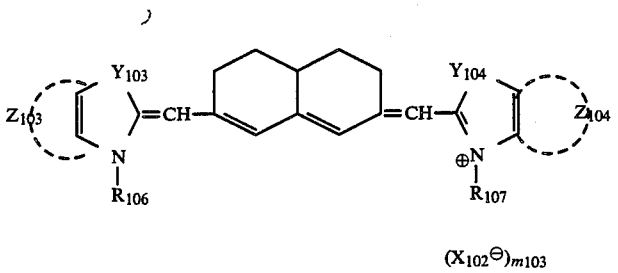

In formula (N), $Y_{103}$ and $Y_{104}$ each has the same meaning as $Y_{101}$; $R_{106}$ and $R_{107}$ each has the same meaning as $R_{101}$; $Z_{103}$ and $Z_{104}$ each has the same meaning as $Z_{101}$; $X_{102}$ has the same meaning as $X_{101}$; and $m_{103}$ has the same meaning as $m_{102}$.

The expression "same meaning" as used above is intended to have the same definition as given in formula (M).

Formula (O)

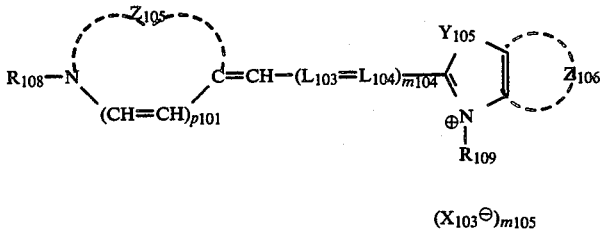

In formula (O), $Z_{105}$ represents atoms necessary to complete a 4-quinoline nucleus or a 2-quinoline nucleus; $Z_{106}$ has the same meaning as $Z_{101}$; $p_{101}$ represents 0 or 1; $m_{104}$ represents 2 or 3; $Y_{105}$ has the same meaning as $Y_{101}$; $R_{108}$ and $R_{109}$ each has the same meaning as $R_{101}$; $X_{103}$ has the same meaning as $X_{101}$; $m_{105}$ has the same meaning as $m_{102}$; and $L_{103}$ and $L_{104}$ each has the same meaning as $L_{101}$.

The expression "same meaning" as used above is intended to have the same definition as given in formula (M).

Formula (P)

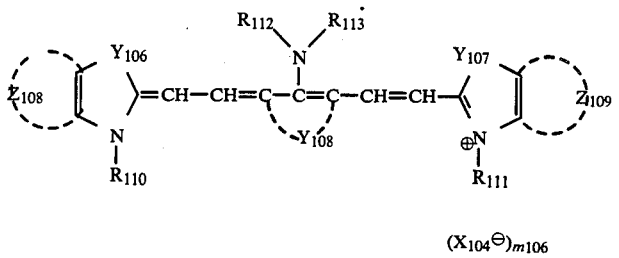

In formula (P), $Z_{108}$ and $Z_{109}$ each has the same meaning as $Z_{101}$; $R_{110}$ and $R_{111}$ each has the same meaning as $R_{101}$; $Y_{108}$ has the same meaning as Y; $X_{104}$ has the same meaning as $X_{101}$; $m_{106}$ has the same meaning as $m_{102}$; and $Y_{106}$ and $Y_{107}$ each has the same meaning as $Y_{101}$ (wherein the expression "same meaning" is intended to have the same definition as given in formula (M)).

$R_{112}$ and $R_{113}$ each represents an alkyl group containing from 1 to 4 carbon atoms or a phenyl group, or they may represent atoms necessary to form a 5- or 6-membered hetero ring by combining with each other.

Formula (Q)

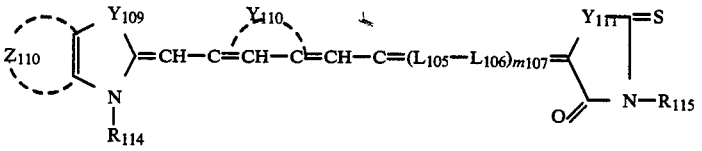

In formula (Q), $Z_{110}$ has the same meaning as $Z_{101}$; $Y_{109}$ has the same meaning as $Y_{101}$; $Y_{111}$ represents an oxygen atom, a sulfur atom, a selenium atom or =N—$R_{116}$ (wherein $R_{116}$ has the same meaning as $R_{105}$); $R_{114}$ has the same meaning as $R_{101}$; $R_{115}$ can have the same meaning as $R_{101}$ but also can represent a phenyl group, a pyridyl group, a substituted phenyl group or a substituted pyridyl group (substituent groups of which include a sulfonyl group, a carboxyl group, a cyano group, a halogen atom (e.g., chlorine, bromine, fluorine, etc.), an alkyl group containing from 1 to 4 carbon atoms, an alkoxy group containing from 1 to 4 carbon atoms, a dialkylamino group, an acyl group, an alkoxycarbonyl group and so on); $Y_{110}$ has the same meaning as Y; $m_{107}$ has the same meaning as $m_{101}$; and $L_{105}$ and $L_{106}$ each has the same meaning as $L_{101}$.

The expression "same meaning" as used above is intended to have the same definition as given in formula (M).

Formula (R)

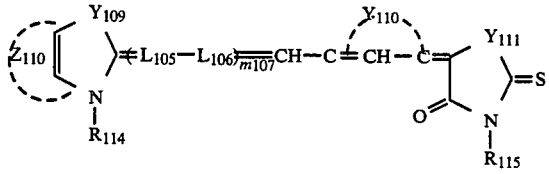

In formula (R), $Z_{110}$, $Y_{109}$, $Y_{110}$, $Y_{111}$, $R_{114}$, $R_{115}$, $L_{105}$, $L_{106}$ and $m_{107}$ has the same meanings as those in formula (Q), respectively.

Formula (S)

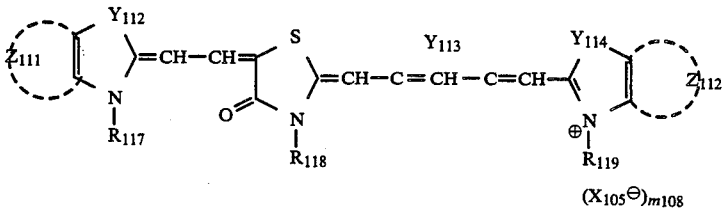

In formula (S), $Z_{111}$ and $Z_{112}$ each has the same meaning as $Z_{101}$; $Y_{112}$ and $Y_{114}$ each has the same meaning as $Y_{101}$; $R_{117}$ and $R_{119}$ each has the same meaning as $R_{101}$; $R_{118}$ has the same meaning as $R_{105}$; $Y_{113}$ has the same meaning as Y; $X_{105}$ has the same meaning as $X_{101}$; and $m_{108}$ has the same meaning as $m_{102}$ (wherein the expression "same meaning" is intended to have the same definition as given in formula (M)).

Formula (T)

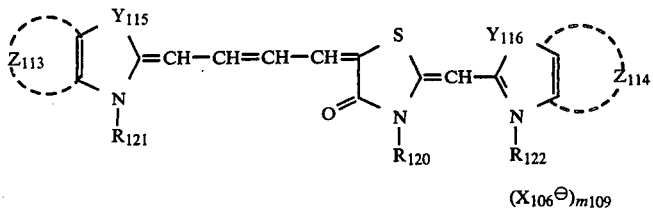

In formula (T), $Z_{113}$ and $Z_{114}$ each has the same meaning as $Z_{101}$; $Y_{115}$ and $Y_{116}$ each has the same meaning as $Y_{101}$; $R_{121}$ and $R_{122}$ each has the same meaning as $R_{101}$; $X_{106}$ has the same meaning as $X_{101}$; and $m_{109}$ has the same meaning as $m_{102}$ (wherein the expression "same meaning" is intended to have the same definition as given in formula (M)).

$R_{120}$ has the same meaning as $R_{118}$ defined in the description of formula (S).

Formula (U)

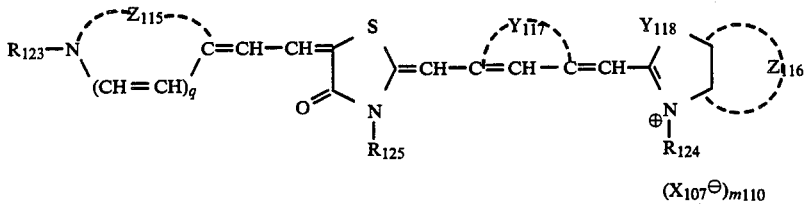

In formula (U), $Y_{117}$ has the same meaning as Y; $Y_{118}$ has the same meaning as $Y_{101}$; $Z_{115}$ has the same meaning as $Z_{105}$ in the formula (O); $Z_{116}$ has the same meaning as $Z_{101}$; $R_{123}$ and $R_{124}$ each has the same meaning as $R_{101}$; q represents 0 or 1; $X_{107}$ has the same meaning as $X_{101}$; and $m_{110}$ has the same meaning as $m_{102}$ (wherein the expression "same meaning" is intended to have the same definition as given in formula (M)).

$R_{125}$ has the same meaning as $R_{118}$ defined in the description of formula (S).

Formula (W)

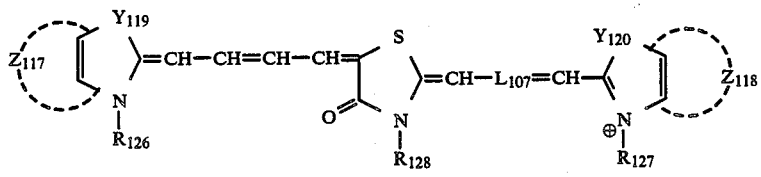

In formula (W), $Z_{117}$ and $Z_{118}$ each has the same meaning as $Z_{101}$; $Y_{119}$ and $Y_{120}$ each has the same meaning as $Y_{101}$; $R_{126}$ and $R_{127}$ each has the same meaning as $R_{101}$; $X_{108}$ has the same meaning as $X_{101}$; $m_{111}$ has the same meaning as $m_{102}$; and $L_{107}$ has the same meaning as $L_{101}$ (wherein the expression "same meaning" is intended to have the same definition as given in formula (M)).

$R_{128}$ has the same meaning as $R_{118}$ in formula (S).

Formula (Y)

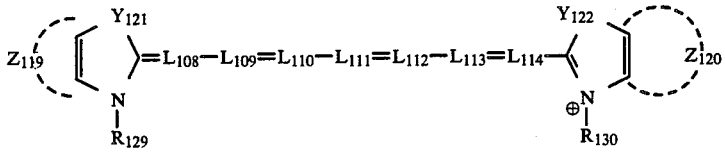

In formula (Y), $Z_{119}$ and $Z_{120}$ each has the same meaning as $Z_{101}$; $Y_{121}$ and $Y_{122}$ each has the same meaning as $Y_{101}$; $R_{129}$ and $R_{130}$ each has the same meaning as $R_{101}$; $L_{108}$, $L_{109}$, $L_{110}$, $L_{111}$, $L_{112}$, $L_{113}$ and $L_{114}$ each has the same meaning as $L_{101}$; $X_{109}$ has the same meaning as $X_{101}$; and $m_{112}$ has the same meaning as $m_{102}$ (wherein the expression "same meaning" is intended to have the same definition in formula (M)).

A single kind of sensitizing dye may be employed, or two or more kinds of sensitizing dyes may be used together. In the latter case, they may all be added together in the form of mixture, or they may be added separately, or the time for adding them may be staggered with one kind at a time being added. The combined use of two or more kinds of sensitizing dyes may include the use of supersensitizing dyes.

The dyes can be added either onto the liquid surface or into the liquid. The stirring can be carried out using any conventional stirring means.

The sensitizing dyes may be added in the form of solution dissolved in an organic solvent compatible with water, such as methanol, ethanol, propanol, fluorinated alcohol, methyl cellosolve, dimethylformamide, acetone, etc., or water (alkaline or acidic). The above-described solvents may be used alone or as a combination of two or more. Also, the sensitizing dyes may be added in the form of a dispersion dispersed in the water-gelatin dispersion system or in the form of a powder obtained by freeze-drying. In addition, the powder dispersed with a surface active agent may be added in the form of a solution.

A generally suitable addition amount of the sensitizing dye is from 0.001 to 20 g, and preferably the amount is from 0.01 to 2 g, per 100 g of silver to be used for making an emulsion.

A generally suitable concentration of the sensitizing dye in a reaction solution used at the chemical sensitization process of silver halide emulsions is 1 wt% or less, and preferably the concentration is 0.1 wt% or less.

Spectral sensitization of the silver halide emulsion with a sensitizing dye and chemical sensitization thereof have been hitherto considered as different steps from each other and, in general, the spectral sensitization with a sensitizing dye is performed after the completion of the chemical sensitization. On the contrary, the above described chemical sensitization is carried out in the presence of the foregoing sensitizing dyes in the present invention and this is the most important feature of the present invention. Although the behavior of the silver halide emulsions thus-prepared is not entirely clear, when such silver halide emulsions are used in light-sensitive materials containing a base and/or a base precursor, not only the preservability of the light-sensitive materials in improved but also the light-sensitive materials having a low fog density can be obtained.

Sensitizing dyes of the same or different kinds, or supersensitizing agents may further be added during formation of silver halide grains used in the silver halide emulsion prepared in the present invention, or during another step to be carried out before coating of the emulsion.

Examples of supersensitizing agents which can be used in the present invention include aminostyryl compounds substituted with nitrogen-containing heterocyclic groups (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds and so on. Combinations as described in U.S. Pat. Nos. 3,615,613, 3,615,641, 3,617,295 and 3,635,721 are particularly useful.

Examples of silver halides which can be employed in the present invention include silver chloride, silver chlorobromide, silver chloroiodide, silver bromide, silver iodobromide, silver chloroiodobromide, silver iodide and so on.

Taking the case of silver iodobromide, such can be obtained by adding firstly a silver nitrate solution to a potassium bromide solution to prepare silver bromide grains, and then adding potassium iodide thereto.

Two or more kinds of silver halides which have a grain size and/or halogen composition different from each other may be used together.

Suitable methods for forming silver halide grains which can be employed in the present invention include well known single jet and double jet methods. Also, the so-called controlled double jet method, in which the pAg of the reaction solution is maintained constant, can be employed. Further, combinations of the above-described methods may be employed. In any of the above-described silver halide grain-forming methods, either known monostage or multistage addition procedures may be employed. Therein, addition may be carried out either at a constant rate, or at stepwise or continuously varied rates (the latter addition can be effected by, for example, changing the addition flow rates of a soluble silver salt solution and a halide solution as a concentration of the soluble silver salt and/or that of the halide are/is kept constant, changing the soluble silver salt concentration and/or the halide concentration in their respective solutions as the addition flow rates of the solutions are kept constant, or combining the above-described addition techniques). The stirring of the reaction solution can be achieved using any conventional techniques. The temperature and the pH of the reaction solution in the course of forming silver halide grains may be adjusted to any values. In the case of sensitizing dyes of a certain kind, however, it is desired that the values should be selected from such a range that the dyes present in the reaction solution are not destroyed.

In methods for forming silver halide grains which can be employed in the present invention, known silver halide solvents and crystal habit-controlling agents (e.g., ammonia, thiocyanogen, organic thioether derivatives, thiocarbamic acid ester derivatives, dithiocarbamic acid ester derivatives and so on) can be used, independently or in combination.

As a result of forming silver halide grains in various manners as described above, some cases occur in which the silver halide grains have a regular crystal form, such as that of a cube or an octahedron, some cases occur in which the silver halide grains have an irregular crystal form, such as that of a sphere, a tabular form or so on, and other cases occur in which the silver halide grains have a composite form of the above-described crystal forms. Whichever form the silver halide grains have, the effects of the present invention can be fully achieved.

Moreover, the effects of the present invention can be achieved without limitation of the silver halide grain structure. Specifically, the interior and the surface of the grains may differ, the grains may be uniform throughout, and so on.

In a process for forming silver halide grains or physical ripening of the silver halide grains, cadmium salts, zinc salts, lead salts, thallium salts, iridium salts or complexes (e.g., iridium (III, IV) chloride, ammonium hexachloroiridate, etc.), rhodium salts or complexes (e.g., rhodium chloride, etc.), iron salts or complexes, and so on may be present.

In preparing the silver halide emulsion used in the present invention, gelatin is used to advantage as a protective colloid. Of course, hydrophilic colloids other than gelatin can also be used.

Examples of such hydrophilic colloids include proteins such as gelatin derivatives, graft polymers of gelatin and other polymers, albumin, casein, etc.; saccharides such as cellulose derivatives such as hydroxyethyl cellulose, carboxymethyl cellulose, cellulose sulfate, etc., sodium alginate, starch derivatives and so on; and various kinds of synthetic hydrophilic high molecular weight substances such as homo- or copolymers, such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole and so on.

Gelatin which can be used in the present invention includes not only lime-processed gelatin but also acid-processed gelatin and enzyme-processed gelatin as described in *Bull. Soc. Sci. Phot. Japan,* No. 16, page 30 (1966). Further, hydrolytic products of gelatin and enzyme decomposition products of gelatin can also be used.

A generally suitable mean diameter of the silver halide grains ranges from 0.001 μm to 10 μm, and preferably the diameter of from 0.001 μm to 5 μm.

Organic silver salts may be coexistent in the light-sensitive material of the present invention. Examples of such organic silver salts are described in Japanese Patent Application (OPI) No. 58543/83, and specific examples thereof are illustrated below.

First of all, silver salts of organic compounds containing carboxyl groups are described. Representative of such compounds are silver salts of aliphatic carboxylic acids and silver salts of aromatic carboxylic acids.

In addition, silver salts of mercapto group- or thion group-containing compounds and derivatives thereof can be cited as examples.

Further, silver salts of imino group-containing compounds are described. Specific examples thereof include silver salts of benzotriazole and derivatives thereof as described in Japanese Patent Publication Nos. 30270/69 and 18416/70, such as the silver salt of benzotriazole; silver salts of alkyl-substituted benzotriazoles, such as the silver salt of methylbenzotriazole; silver salts of halogen-substituted benzotriazoles, such as the silver salt of 5-chlorobenzotraizole; silver salts of carboimidobenzotriazoles, such as the silver salt of butylcarboimidobenzotriazole; silver salts of 1,2,4-triazoles and 1-H-tetrazoles as described in U.S. Pat. No. 4,220,709; silver salts of carbazoles; silver salts of saccharin; silver salts or imidazole and derivatives thereof; and so on.

Furthermore, silver salts as described in *Research Disclosure,* No. 170 (RD-17029) and organic metal salts of copper stearate can be used as organic metal salts acting as oxidizing agents in the present invention.

Further techniques for preparing the foregoing silver halides and organic silver salts and manners for mixing them are described in *Research Disclosure,* No. 170 (RD-17029), Japanese Patent Application (OPI) Nos. 32928/75, 42529/76, 13224/74 and 17216/75 and U.S. Pat. No. 3,700,458, etc.

A suitable coverage of light-sensitive silver halide in the present invention ranges from 1 mg/m$^2$ to 100 g/m$^2$, and more preferably from 10 mg/m$^2$ to 50 g/m$^2$, based on the silver content. When an organic silver salt is used together with the light-sensitive silver halide in the present invention, the total coverage is desirably adjusted within the above described ranges.

The light-sensitive materials of the present invention contain a base and/or a base precursor in order to accelerate development at the time of heating. The base and/or the base precursor may also function as a dye-releasing activator at the release of dyes from dye providing substances in the case where the dye providing substances described hereinafter are included in the light-sensitive materials.

The term "base precursor" used in the present invention is intended to include those compounds which can release basic components upon heating, and the basic components released may be either inorganic or organic.

Suitable examples of inorganic alkalis include hydroxides, secondary or tertiary phosphates, borates, carbonates, quinolinates and metaborates of alkali metals or alkaline earth metals; ammonium hydroxide; hydroxides of quaternary alkylammoniums; hydroxides of other metals; and so on. Examples of organic alkalis include aliphatic amines (such as trialkylamines, hydroxylamines and aliphatic polyamines), aromatic amines (such as N-alkyl-substituted aromatic amines, N-hydroxylalkyl-substituted aromatic amines, and bis[p-(dialkylamino)phenyl]methanes), heterocyclic amines, amidines, cyclic amidines, guanidines, and cyclic guanidines. In addition, betaine iodotetramethyl ammonium and diaminobutane dihydrochloride described in U.S. Pat. No. 2,410,644, and organic compounds containing urea or amino acids, such as 6-aminocaproic acid described in U.S. Pat. No. 3,506,444 can be used to advantage. Of these alkalis, those having a pKa of 8 or higher are particularly useful in the present invention.

Compounds which can undergo a certain reaction upon heating to release an alkali, for instance, salts of organic acid and alkalis which are decomposed through decarboxylation upon heating, compounds which are decomposed by Lossen rearrangement, Beckmann rearrangement or so on, to result in release of amines, and so on can be employed as the base precursor of the present invention.

As examples of preferred base precursors, mention may be made of precursors of the above-described organic alkalis. More specifically, salts of pyrolyzable organic acids, such as trichloroacetic acid, trifluoroacetic acid, propiolic acid, cyanoacetic acid, sulfonylacetic acid, acetoacetic acid and the like, salts of 2-carboxycarboxamides described in U.S. Pat. No. 4,088,496, and so on are preferred.

Specific examples of preferred base precursors are described below. As examples of compounds which are supposed to release an alkali through decarboxylation in their acid moieties, mention may be be made of the following.

Trichloroacetic acid derivatives include guanidinotrichloroacetic acid, piperidinotrichloroacetic acid, morpholinotrichloroacetic acid, p-toluidinotrichloroacetic acid, 2-picolinotrichloroacetic acid and the like.

In addition, base precursors described in British Pat. No. 998,945, U.S. Pat. No. 3,220,846, Japanese Patent Application (OPI) No. 22625/75 and so on can be used.

Besides trichloroacetic acid derivatives, there can be cited 2-carboxycarboxamide derivatives described in U.S. Pat. No. 4,088,496, α-sulfonylacetate derivatives described in U.S. Pat. No. 4,060,420, and alkali salts of propiolic acid derivatives described in European Patent Application 0123937A.

Salts which contain as an alkali component an alkali metal or an alkaline earth metal, other than an organic alkali, can be used effectively, and such salts are described, e.g., in European Patent Application 0125521A.

In addition to the above-described precursors, hydroxamcarbamates described in European Patent Application 0120661A, in which Lossen rearrangement is utilized, aldoxime carbamates capable of producing nitrile, which are described in European Patent Application 0118078A, and so on can also be used effectively.

Moreover, amine imides as described in *Research Disclosure,* RD-15776 (May, 1977) and aldone amides as described in Japanese Patent Application (OPI) No.

22625/75, which decompose at high temperatures to produce bases, can be used advantageously.

Among the base and the base precursor, an organic alkali and an organic alkali precursor are preferred.

The base or the base precursor in the present invention can be used in a very wide range of addition amount. A useful coverage thereof is 50 wt% or less, and more preferably is from 0.01 to 40 wt%, based on the total weight of dried coatings of the light-sensitive material.

In the present invention, a wide variety of image forming substances can be used in various manners.

For instance, couplers capable of producing color images by binding to oxidation products of developing agents employed in liquid development processing, which have so far been widely known, with specific examples including magenta couplers such as 5-pyrazolone couplers, pyrazolobenzimidazole couplers, cyanoacetylcumarone couplers, open chain acylacetonitrile couplers and so on, yellow couplers such as acylacetamide couplers (e.g., benzoylacetanilides pivaloylacetanilides, etc.), and cyan couplers such as naphthol couplers and phenol couplers, can be used.

It is generally desirable that these couplers should be rendered nondiffusible by containing a hydrophobic group which acts as a ballast group in their individual molecules. The couplers may be either 4-equivalent or 2-equivalent with respect to silver ion. Further, these couplers may be colored couplers having a color correction effect, or couplers capable of releasing development restrainers upon development (so-called DIR couplers).

In addition, dyes which can produce positive color images using light-sensitive silver dye bleach processes, for example, dyes as described in *Research Disclosure,* pp. 30–32 (RD-14433) (April, 1976); ibid., pp. 14–15 (RD-15227) (December, 1976), U.S. Pat. No. 4,235,957 and so on, and leuco dyes as described in U.S. Pat. Nos. 3,985,565 and 4,022,617, can be used.

Also, dyes into which nitrogen-containing heterocyclic groups are introduced as described in *Research Disclosure,* pp. 54–58 (RD-16966) (May, 1978) can be used.

Moreover, dye providing substances as described in European Pat. No. 79,056, West German Pat. No. 3,217,853 and European Pat. No. 67,455, from which mobile dyes are released through the coupling reaction with reducers oxidized by the redox reaction with silver halide or organic silver salts under high temperatures, and dye providing substances described in European Pat. Nos. 66,282 and 76,492, West German Pat. No. 3,215,485, and European Patent Application 0120306A and 0119470A, which undergo the redox reaction with silver halide or organic silver salts under high temperatures, and release mobile dyes as a result of this reaction, can be used.

Dye providing substances which can be used in the above-described processes are represented by formula (I):

$$D—Y \qquad (I)$$

wherein D represents a dye moiety or a precursor thereof, and Y represents a substrate having such a function as to change the diffusibility of the dye providing substance (I) upon the redox reaction caused in the heat development step.

The expression "change in diffusibility" is intended to include the cases wherein (1) the compound (I) is nondiffusible originally, and it is changed into a diffusible compound or release a diffusible dye, and (2) the compound (I) is originally diffusible, and changed into a nondiffusible compound. This change is caused by oxidation of Y or reduction of Y according to the nature of Y, and these two reactions are used appropriately according to the circumstances.

As examples of Y whose diffusibility is changed by oxidation, mention may be made of the so-called dye releasing redox substrates such as p-sulfonamidonaphthols (including p-sulfonamidophenols, anad specific examples thereof described in Japanese Patent Application (OPI) Nos. 33826/73 and 50736/78, and European Pat. No. 76,492), o-sulfonamidonaphthols (including o-sulfonamidophenols, and specific examples thereof described in Japanese Patent Applicaton (OPI) Nos. 113624/76, 12642/81, 16130/81, 16131/81, 4043/82 and 650/82, U.S. Pat. No. 4,053,312, and European Patent 76,492), hydroxysulfonamidoheterocyclic rings (with specific examples described in Japanese Patent Application (OPI) No. 104343/76 and European Pat. No. 76,492), 3-sulfonamidoindoles (with specific examples described in Japanese Patent Application (OPI) Nos. 104343/76, 46730/78, 130122/79 and 85055/82 and European Pat. No. 76,492) and so on.

As examples of Y of a different type which release a dye by intramolecular nucleophilic attack after oxidation, mention may be made of intramolecular assist type substrates described in Japanese Patent Application (OPI) No. 20735/82 and European Patent Application No. 0106211A.

As examples of Y of another different type which releases a dye by an intramolecular ring closure reaction under alkaline conditions, but causes substantially no release of a dye when oxidized, mention may be made of the substrates described in Japanese Patent Application (OPI) No. 63618/76. In addition, substrates which are modifications of the above-described type of Y, and release dyes through winding change caused in an isoxazoline ring by a nucleophilic agent (specific examples of which are described in Japanese Patent Application (OPI) Nos. 111628/74 and 4819/77) are also useful.

As examples of Y of still another type, mention may be made of substrates which can release their dye moieties through dissociation of an acidic proton under alkaline conditions, but cause substantially no release of dyes when oxidized (specific examples of which are described in Japanese Patent Application (OPI) Nos. 69033/78 and 130927/79).

On the other hand, examples of Y whose diffusibility is changed by reduction include nitro compounds described in Japanese Patent Application (OPI) No. 110827/78 and quinone compounds described in Japanese Patent Application (OPI) No. 110827/78 and U.S. Pat. Nos. 4,356,249 and 4,358,525. These compounds are reduced by a reducer (called an electron donor) remaining without being consumed in the heat development step to produce nucleophilic groups, and release dyes through the molecular attack of the resulting nucleophilic groups. Substrate of the quinone type which are a modification of the above-described quinone compounds and release their dye moieties through dissociation of acidic proton of the reductant thereof are also useful. Specific examples of such quinone type substrates are described in Japanese Patent Application (OPI) Nos. 130927/79 and 164342/81. When the substrates of the kind which cause change in diffusibility by reduction, as described above, are employed, it is essential to use a proper reducer (electron donor) to mediate between a silver salt as oxidizing agent and a dye providing substance, and specific examples of suitable reducers which can be used are described in the above-described known data. In addition, substrates in which an electron donor is present (called LDA compounds) are also useful as Y.

Further, materials which undergo a redox reaction with silver halides or organic silver salts, and as a result thereof a change in mobility of the products containing their dye moieties occurs can be employed as examples of another type of dye-providing material, and specific examples thereof are described in Japanese Patent Application (OPI) No. 165054/84.

Also, materials capable of releasing mobile dyes through the reaction with silver ions present in a light-sensitive material can be employed, and specific examples thereof are described in Japanese Patent Application (OPI) No. 180548/84.

Many of the above-described materials produce the imagewise distribution of mobile dyes corresponding to an exposure pattern in the light-sensitive material by heat development, and the resulting image dyes are transferred into a dye-fixing material (so-called diffusion transfer) and visualized therein. Methods for effecting such procedures are described in the patents cited above or European Patent Application No. 0119615A and so on.

Heat developable light-sensitive materials and processes therefor have been described, for example, in *Shashin Kogaku no Kiso* (The Foundation of Photographic Technology), pages 553 to 555 (published by Corona Co., 1979), *Eizo Jyoho,* page 40 (April, 1978), *Nebletts Handbook of Photography and Reprography,* 7th Ed., pages 32 to 33 (Van Nostrand Reinhold Company), U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1978).

When dye providing substances are used in the present invention, they can be introduced into constituent layers of a light-sensitive material using a known method, e.g., the method described in U.S. Pat. No. 2,322,027, or so on. In introducing them, organic solvents having a high boiling point and/or organic solvents having a low boiling point can be used.

Specifically, dye providing substances are dissolved in an organic solvent having a high boiling point such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate), benzoic acid esters (e.g., octyl benzoate), alkylamides (e.g., diethyllaurylamide), fatty acid esters (e.g., dibutoxyethyl succinate, dioctyl azelate, etc.), trimesic acid esters (e.g., tributyl trimesate) and so on, or an organic solvent having a boiling point of from about 30° C. to 160° C. such as lower alkyl acetates like ethyl acetate and butyl acetate, ethyl propionate, secondary butyl alcohol, methyl isobutyl ketone, $\beta$-ethoxyethyl acetate, methyl cellosolve acetate, cyclohexanone, and so on, and then dispersed into a hydraulic colloid. The above-described organic solvents having a high boiling point and organic solvents having a low boiling point may be used as a mixture of two or more.

Also, the dispersing methods described in Japanese Patent Publication No. 39853/76 and Japanese Patent Application (OPI) No. 59943/76 can be employed. Further, in dispersing dye providing substances into hydrophilic colloids, various kinds of surface active agents can be used.

An organic solvent having a high boiling point employable in the present invention is used in an amount of 10 g or less, preferably 5 g or less, per 1 g of a dye providing substance used.

In the present invention, it is desirable that a reducing substance should be incorporated into the light-sensitive material. Suitable reducing substances include known reducing agents and the foregoing reductive dye providing substances.

Specific examples of suitable reducing agents which can be used in the present invention include hydroquinone compounds (e.g., hydroquinone, 2,5-dichlorohydroquinone, 2-chlorohydroquinone, etc.), aminophenol compounds (e.g., 4-aminophenol, N-methylaminophenol, 3-methyl-4-aminophenol, 3,5-dibromoaminophenol, etc.), catechol compounds (e.g., catechol, 4-cyclohexylcatechol, 3-methoxycatechol, 4-(N-octadecylamino)catechol, etc.), phenylenediamine compounds (e.g., N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.) and so on.

Examples of more preferred reducing agents include 3-pyrazolidone compounds, such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methyl-3-pyrazolidone.

Combinations of various developing agents as disclosed in U.S. Pat. No. 3,039,869 can also be employed as a reducing agent.

A generally suitable amount of a reducing agent used in the present invention ranges from 0.01 to 20 mols, and particularly preferably the amount is from 0.1 to 10 mols, per 1 mol of silver.

In the present invention, if necessary, so-called auxiliary developing agents can be used, even when reductive dye providing substances are present. The auxiliary developing agent in this case is a compound which is oxidized by the silver halide and/or organic silver salt to form its oxidized product which has the ability to oxidize the reducing group in the dye providing substance.

Examples of useful auxiliary developing agents include hydroquinone, alkyl substituted hydroquinones such as tert-butylhydroquinone, 2,5-dimethylhydroquinones, etc., catechols, pyrogallols, halogen substituted hydroquinones such as chlorohydroquinone, dichlorohydroquinone, etc., alkoxy substituted hydroquinones such as methoxyhydroquinone, etc. and polyhydrobenzene derivatives such as methyl hydroxynaphthalene, etc. Further, methyl gallate, ascorbic acid, ascorbic acid derivatives, hydroxylamines such as N,N'-di(2-ethoxyethyl)hydroxylamine, etc., pyrazolidones such as 1-phenyl-3-pyrazolidone, 4-methyl-4-hydroxymethyl-1-phenyl-3-pyrazolidone, etc., reductones, hydroxy tetronic acids, and the like are useful.

The auxiliary developing agent is used in an appropriate amount. A suitable amount range is generally from 0.0005 times by mol to 20 times by mol based on the amount of silver. A particularly suitable range is from 0.001 time by mol to 4 times by mol.

Binders which can be used in the present invention can be used singly or as a combination thereof. Such binders can be hydrophilic. Representative of hydrophilic binders are transparent or translucent hydrophilic colloids, with specific examples including natural substances such as proteins (e.g., gelatin, gelatin derivatives, etc.) and polysaccharides (e.g., cellulose derivatives, starch, gum arabic, pullulan, dextrin, etc.), and synthetically polymerized substances such as water-soluble polyvinyl compounds (e.g., polyvinyl alcohol, polyvinyl pyrrolidone, acrylamide polymers, etc.). Other synthetic polymers which can be used include vinyl compounds in a dispersion state which can contribute particularly to increasing dimensional stability of a photographic material when incorporated in a latex form.

In addition, compounds which can promote the activation of development and the stabilization of formed images at the same time can be employed in the present invention. Of such compounds, isothiuroniums, represented by 2-hydroxyethylisothiuronium trichloroacetate as described in U.S. Pat. No. 3,301,678, bisisothiuroniums such as 1,8-(3,6-dioxaoctane)bis(isothiuronium trichloroacetate) and the like as described in U.S. Pat. No. 3,669,670, thiol compounds as described in West German Patent Application (OLS) No. 2,162,714, thiazolium compounds such as 2-amino-2-thiazolium trichloroacetate, 2-amino-5-bromoethyl-2-thiazolium trichloroacetate and the like as described in U.S. Pat. No. 4,012,260, compounds having as their acidic moieties a 2-carboxycarboxamide such as bis(2-amino-2-thiazolium)methylenebis(sulfonylacetate), 2-amino-2-thiazolium phenylsulfonylacetate, etc., described in U.S. Pat. No. 4,060,420, and so on, are more preferably used.

Further, azole thioether and blocked azolinethione compounds as described in Belgian Pat. No. 768,071, 4-aryl-1-carbamyl-2-tetrazoline-5-thione compounds as described in U.S. Pat. No. 3,893,859, and other compounds as described in U.S. Pat. Nos. 3,839,041, 3,844,788 and 3,877,940 can also be used preferably.

The light-sensitive material of the present invention can contain a toning agent, if desired. Effective toning agents include 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above may be varied depending upon the kind of a heat developable light-sensitive material used, processing conditions, desired images and various other factors, but generally range from about 0.001 to 0.1 mol per mol of silver in the light-sensitive material.

A support to be used for the light-sensitive material in the present invention and for a dye-fixing material which may be employed in the present invention according to circumstances is one which can withstand processing temperatures. Examples of supports which can be generally used include not only glass, paper, metals and their analogs, but also an acetyl cellulose film, a cellulose ester film, a polyvinyl acetal film, a polystyrene film, a polycarbonate film, a polyethylene terephthalate film and their related films or resins materials. Also, a paper support laminated with a polymer such as polyethylene or so on can be used. Further, polyesters as described in U.S. Pat. Nos. 3,634,089 and 3,725,070 are used to advantage.

Photographic emulsion layer and other binder layers, which can constitute the photographic light-sensitive material and the dye-fixing material according to the present invention, may contain an inorganic or organic hardening agent. Specifically, chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.) and so on can be used alone or in combination.

The photographic emulsion layer and other hydrophilic colloid layers in the light-sensitive material of the present invention may contain various surface active agents for various purposes, for example, as coating aids, or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfonic acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

A dye transfer assistant can be utilized in transferring the dyes from the light-sensitive layers into the dye-fixing layer.

Examples of dye transfer assistants which can be employed in an externally supplied form include water and basic aqueous solutions containing sodium hydroxide, potassium hydroxide, or an inorganic alkali metal salt. In addition, low boiling point solvents such as methanol, N,N-dimethylformamide, acetone, diiosbutyl ketone and the like, or mixed solutions prepared from these low boiling point solvents and water or basic aqueous solutions can also be used. The dye transfer assistants may be used in such a manner that an image-receiving layer is wetted therewith.

If the dye transfer assistant is incorporated into the light-sensitive material or the dye fixing material, it is unnecessary to supply the transfer assistant externally. The above-described dye transfer assistants may be incorporated into the material in the form of water of crystallization or microcapsules, or as precursors capable of releasing the above-described solvents under high temperatures. It is more desirable to incorporate a hydrophilic thermal solvent, which is in a solid state at ordinary temperature and can be fused under high temperatures, into the light-sensitive material or the dye fixing material. Such a hydrophilic thermal solvent may be incorporated into either the light-sensitive material or the dye fixing material, or may be incorporated into both materials. In addition, such a solvent may be incorporated into any constituent layer such as an emulsion layer, an interlayer, a protective layer or a dye fixing layer. However, incorporation into a dye fixing layer and/or its adjacent layers can produce preferable results.

Examples of suitable hydrophilic thermal solvents which can be used include ureas, pyridines, amides, sulfonamides, imides, alcohols, oximes and other heterocyclic compounds.

Other compounds which can be used in the light-sensitive material of the present invention, for example, sulfamide derivatives, cationic compounds containing a pyridinium group, surface active agents having polyethylene oxide chains, sensitizing dyes, antihalation and anti-irradiation dyes, hardening agents, mordants and so on, are those as described in European Pat. Nos. 74,492 and 66,282, West German Pat. No. 3,315,485 and Japanese Patent Application (OPI) Nos. 154445/84 and 152440/84, etc.

Further, methods for the exposure cited in the above-described patents can be employed in the present invention also.

The light-sensitive materials of the present invention have good preservability in addition to their rapidly developable property by heating. More specifically, they are excellent in that not only the decrease in sensitivity but also the increase in fog with the lapse of time are prevented. Such excellent properties are exhibited not only in cases wherein the final images are formed in the light-sensitive material but also in cases wherein the final images are formed in a dye fixing material different from the light-sensitive material. Therefore, the present invention is extremely useful.

The present invention will be explained in greater detail with reference to the following examples, but the present invention should not be construed as being limited thereto.

EXAMPLE 1

(1) Silver chlorobromide emulsion (A) was prepared in the following manner.

800 ml of an aqueous solution containing 5 g of sodium chloride and 20 g of gelatin dissolved therein was maintained at 55° C. and thereto were simultaneously added a solution containing 50 g of silver nitrate dissolved in 400 ml of water and a solution containing 19 g of potassium bromide and 8 g of sodium chloride dissolved in 400 ml of water over a period of 20 minutes.

Then after removing excess salts from the emulsion by flocculation method, 250 ml of water and 25 g of gelatin were added to the emulsion, and thereafter the pH thereof was adjusted to 6.3, to which were added 2 ml of a 0.1% aqueous solution of sodium thiosulfate and 5 ml of a 1% aqueous solution of nucleic acid and the emulsion was stirred at 60° C. for 30 minutes. The amount of the emulsion thus-obtained was 500 g.

(2) Silver chlorobromide emulsion (B) was prepared in the following manner.

Emulsion (B) was prepared in the same manner as described for Emulsion (A) except that 150 ml of a 0.04% by weight of methanol solution of Dye I shown below was added at the same time of the addition of the aqueous solution of silver nitrate and the aqueous solution of potassium bromide and sodium chloride over a period of 20 minutes in the preparation step of Emulsion (A). cl * Dye I

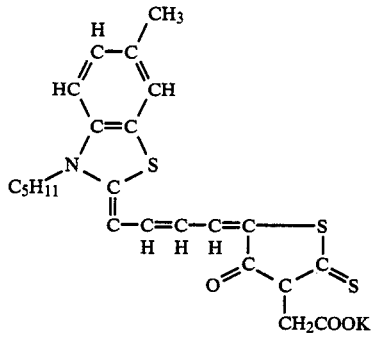

(3) Silver chlorobromide emulsion (C) was prepared in the following manner.

Emulsion (C) was prepared in the same manner as described for Emulsion (A) except that 150 ml of the methanol solution of Dye I shown above was added 20 minutes after the addition of the aqueous solution of sodium thiosulfate and the aqueous solution of nucleic acid in the preparation step of Emulsion (A).

(4) Silver 5-chlorobenzotriazole emulsion was prepared in the following manner.

28 g of gelatin and 16.8 g of 5-chlorobenzotriazole were dissolved in a mixture of 1000 ml of water and 2000 ml of ethanol and the solution was stirred while maintaining the temperature at 40° C. Then, to the solution was added a solution containing 17 g of silver nitrate dissolved in 100 ml of water over a period of 2 minutes.

The excess salts of the silver 5-chlorobenzotriazole emulsion was removed by flocculation method, and thereafter the pH of the emulsion was adjusted to 6.0 to obtain the silver 5-chlorobenzotriazole emulsion in a yield of 400 g.

A method of preparing a gelatin dispersion of a dye providing substance is described below.

A mixture of 5 g of Cyan dye providing substance shown below, 0.5 g of sodium 2-ethylhexyl succinate sulfonate, 5 g of tricresyl phosphate (TCP) and 30 ml of ethyl acetate was dissolved by heating at about 60° C. to prepare a uniform solution. This solution was mixed and stirred with 100 g of a 10% aqueous solution of lime-processed gelatin and the mixture was dispersed by means of a homogenizer at 10,000 rpm for 10 minutes.

* Cyan dye providing substance

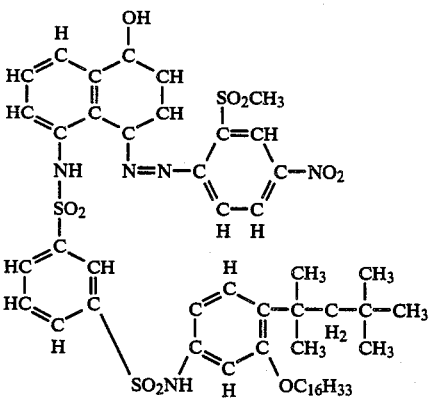

Preparation of a light-sensitive mateiral A

| | | |
|---|---|---|
| (a) | Silver chlorobromide emulsion (A) | 5 g |
| (b) | 0.04% Methanol solution of Dye I | 1.5 ml |
| (c) | Silver 5-chlorobenzotriazole emulsion | 10 g |
| (d) | Dispersion of above-described Cyan dye providing substance | 33 g |
| (e) | 5% Aqueous solution of Compound AA having the following formula: | 5 ml |
| (f) | 10% Ethanol solution of guanidine trichloroacetate | 12 ml |
| (g) | 10% Aqueous solution of a compound having the following formula: $H_2NSO_2N(CH_3)_2$ | 4 ml |

*Compound AA

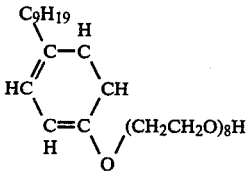

The above components (a) to (g) were mixed and dissolved and the mixture was coated on a polyethylene terephthalate film in a wet thickness of 30 μm and then dried.

On the thus-formed layer, a solution having the following composition was coated in a wet thickness of 25 μm and dried to prepare a protective layer.

| | | |
|---|---|---|
| (h) | 10% Aqueous solution of lime-processed gelatin | 35 g |
| (i) | 10% Ethanol solution of guanidine trichloroacetate | 6 ml |
| (j) | 1% Aqueous solution of sodium 2-ethylhexyl succinate sulfonate | 4 ml |
| (k) | Water | 5 ml |

Preparation of light-sensitive material B

Light-sensitive material B was prepared in the same manner as described for light-sensitive material A except that 1.5 ml of water was used in place of the methanol solution of Dye I and that 5 g of silver chlorobromide emulsion (B) was used in place of silver chlorobromide emulsion (A) in the preparation step of light-sensitive material A Preparation of light-sensitive material C Light-sensitive material C was prepared in the same manner as described for light-sensitive material A except that 6.5 g of silver chlorobromide emulsion (C) was used in place of silver chlorobromide emulsion (A) and that the methanol solution of Dye I was not added.

A method of preparing a dye fixing material is described below.

10 g of a methyl acrylate/N,N,N-trimethyl-N-vinylbenzylammonium choride (1:1) copolymer was dissolved in 200 ml of water and the resulting solution was uniformly mixed with 100 g of 10% lime-processed gelatin. The resulting mixture was coated in a wet thickness of 90 μm on a paper support laminated with polyethylene with titanium dioxide dispersed therein. The thus-prepared material was dried and then used as a dye fixing material having a mordant layer.

Light-sensitive materials A, B and C, immediately after preparation, were exposed to light and then uniformly heated on a heat block at 150° C. for 30 seconds. Also the same samples which were preserved at 40° C. for 1 day were subjected to the same procedure as described above.

The foregoing dye fixing material was dipped in water and then the above-described heated light-sensitive material was superimposed on the dye fixing material in such a manner that the coated layers were in contact with each other. This superimposed member was heated on a heat block at 80° C. for 6 seconds. Then, the dye fixing material was peeled apart from the light-sensitive material. Thus negative cyan color images were obtained on the dye fixing material.

The sensitivity of the negative images to red light was measured using a Macbeth reflection densitometer (RD-519). The results obtained are shown in Table 1.

TABLE 1

| Light-Sensitive Material | Decrease in Sensitivity after Preservation at 40° C. for 1 day (log unit) | Fog |
|---|---|---|
| A (Comparison) | −0.61 | 0.15 |
| B (Comparison) | ±0 | 0.25 |
| C (Present Invention) | −0.02 | 0.17 |

From the results shown in Table 1 it is apparent that with light-sensitive material A for comparison the decrease in sensitivity is remarkably large while the fog formation is little after the forced aging test and with light-sensitive material B for comparison the fog remarkably increases while the sensitivity does not decrease. On the contrary, both the decrease in sensitivity and the fog formation are small with light-sensitive material C according to the present invention. These results clearly demonstrate the excellent property of the light-sensitive material of the present invention.

EXAMPLE 2

3.8 g of Emulsion A prepared in Example 1 was dissolved, and thereto 0.2 ml of the methanol solution of Dye I employed in Example 1 was added and allowed to stand for a while. Thereafter, 1 g of an emulsion containing the coupler illustrated below, a solution prepared by dissolving 100 mg of 2,6-dichloro-p-aminophenol in 1 ml of methanol, and a solution prepared by dissolving 100 mg of guanidine trichloroacetate in 1 ml of ethanol were further added thereto. The resulting solution was coated on a polyethylene terephthalate film in a wet thickness of 60 μm, and then dried. The light-sensitive material thus-prepared was designated "Light-sensitive material 201".

* Coupler

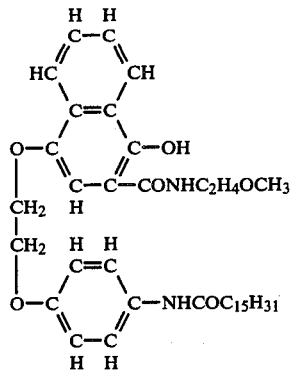

The emulsion containing the above-illustrated coupler was prepared in the following manner.

To 100 g of a 10% aqueous gelatin solution dissolved at 40° C., 0.5 g of sodium dodecylbenzenesulfonate was added, and dissolved therein with stirring.

10 g of the above described coupler, 5 g of tricresyl phosphate and 20 ml of ethyl acetate were mixed and dissolved by heating. Then, the gelatin solution containing the surfce active agent and the solution containing the coupler were emulsified and dispersed, using a homogenizer at 12,000 rpm for 3 minutes. Thus, the coupler emulsion was obtained.

Also, light-sensitive material 202 was prepared in the same manner as described for light-sensitive material 201 except that 5 g of Emulsion (B) as described in Example 1 was used in place of Emulsion (A) and that 0.2 ml of water was used in place of the methanol solution of Dye I.

Further, light-sensitive material 203 was prepared in the same manner as described for light-sensitive material 201 except that 4 g of Emulsion (C) as described in Example 1 was used in place of Emulsion (A) and that the methanol solution of Dye I was not added.

Moreover, light-sensitive materials 204 to 206 were prepared in the same manner as described for light-sensitive materials 201 to 203, respectively, except that sodium trichloroacetate was employed in place of guanidine trichloroacetate.

Immediately after preparation, the above-described light-sensitive materials 201, 202, 203, 204, 205 and 206 were exposed to light using a tungsten lamp of 2,000 luxes through a wedge filter for 4 seconds, and then were heated uniformly on a heat block at 140° C. for 30 seconds.

Same materials which were allowed to stand for 1 day at 40° C. were subjected to the same procedure as described above.

After being dipped in a 0.1N aqueous solution of sodium hydroxide, an image-receiving material prepared in the manner as described below was brought into face-to-face contact with the light-sensitive materials, each of which had just received the heating treatment. After a lapse of 30 seconds, the image-receiving material was stripped off the light-sensitive material. Thus, negative cyan color image having high degree of clearness of less turbidity was obtained on the image-receiving material.

The above-described image-receiving material was prepared in the following manner.

10 g of a methylacrylate/N,N,N-trimethyl-N-vinylbenzylammonium chloride (1/1) copolymer was dissolved in 200 ml of water, and mixed uniformly with 100 g of a 10% aqueous lime-processed gelatin solution. The resulting mixture was coated on a polyethylene terephthalate film uniformly in a wet thickness of 20 μm, and dried.

Sensitivities of the color images obtained by heating were measured, and shown in Table 2 as relative values of light-sensitive material 201 in a condition of immediately after coating as 100.

TABLE 2

| Light-sensitive Material | Sensitivity | | Fog |
|---|---|---|---|
| | Immediately after Coating | After lapse of 1 day at 40° C. | Immediately after Coating |
| 201 (Comparison) | 100 | 25 | 0.25 |
| 202 (Comparison) | 103 | 100 | 0.35 |
| 203 (Present Invention) | 105 | 97 | 0.26 |
| 204 (Comparison) | 103 | 23 | 0.23 |
| 205 (Comparison) | 105 | 100 | 0.36 |
| 206 (Present Invention) | 107 | 100 | 0.25 |

It is demonstrated from the results shown in Table 2 that the excellent effects can be obtained by using the light-sensitive materials according to the present invention together with image-receiving materials.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having thereon (1) a light-sensitive hydrophilic colloid silver halide emulsion, (2) at least one of a base and a base precursor, and (3) a hydrophilic binder, wherein the light-sensitive hyrophilic colloid silver halide emulsion is one which is chemically sensitized in the presence of a spectral sensitizing dye added after the formation of the silver halide grains but before completion of chemical sensitization.

2. A heat developable light-sensitive material as claimed in claim 1, wherein the light-sensitive hydrophilic colloid silver halide emulsion is chemically sensitized by a sulfur sensitization method using active gelatin or a compound containing sulfur capable of reacting with silver, a sensitization method using a compound containing selenium or tellurium, a reduction sensitization method using a reducing material, a noble metal sensitization method using a noble metal compound or a combination thereof.

3. A heat developable light-sensitive material as claimed in claim 1, wherein the spectral sensitizing dye is a methine dye.

4. A heat developable light-sensitive material as claimed in claim 3, wherein the methine dye is a cyanine dye, a merocyanine dye, a complex cyanine dye, a complex merocyanine dye, a holopolar cyanine dye, a hemicyanine dye, a styryl dye or a hemioxonol dye.

5. A heat developable light-sensitive material as claimed in claim 3, wherein the methine dye is a cyanine dye, a merocyanine dye or a complex merocyanine dye.

6. A heat developable light-sensitive material as claimed in claim 4, wherein the cyanine dye has, as a basic heterocyclic nucleus, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus, a nucleus formed by fusing together one of the above-described nuclei and an alicyclic hydrocarbon ring; or a nucleus formed by fusing together one of the above-described nuclei and an aromatic hydrocarbon ring.

7. A heat developable light-sensitive material as claimed in claim 6, wherein the fused nucleus is an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus.

8. A heat developable light-sensitive material as claimed in claim 4, wherein the merocyanine dye or the complex merocyanine dye contains a 5-membered or 6-membered heterocyclic nucleus.

9. A heat developable light-sensitive material as claimed in claim 8, wherein the 5-membered or 6-membered heterocyclic nucleus is a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus.

10. A heat developable light-sensitive material as claimed in claim 1, wherein an amount of the sensitizing dye is from 0.001 to 20 g per 100 g of silver to be used for making a silver halide emulsion.

11. A heat developable light-sensitive material as claimed in claim 10, wherein the amount of the sensitizing dye is from 0.01 to 2 g per 100 g of silver to be used for making a silver halide emulsion.

12. A heat developable light-sensitive material as claimed in claim 1, wherein a concentration of the sensitizing dye in a reaction solution used at the chemical sensitization process of a silver halide emulsion is 1 wt% or less.

13. A heat developable light-sensitive material as claimed in claim 12, wherein the concentration of the sensitizing dye is 0.1 wt% or less.

14. A heat developable light-sensitive material as claimed in claim 1, wherein the light-sensitive material further contains an organic silver salt.

15. A heat developable light-sensitive material as claimed in claim 14, wherein the organic silver salt is a silver salt of an organic compound having a carboxyl group, a silver salt of a compound having a mercapto group or a thione group, or a silver salt of a compound having an imino group.

16. A heat developable light-sensitive material as claimed in claim 15, wherein the organic silver salt is a silver salt of an aliphatic carboxylic acid, a silver salt of an aromatic carboxylic acid, or a silver salt of benzotriazole or a derivative thereof.

17. A heat developable light-sensitive material as claimed in claim 1, wherein the light-sensitive material further contains an image forming substance.

18. A heat developable light-sensitive material as claimed in claim 17, wherein the image forming substance is a coupler.

19. A heat developable light-sensitive material as claimed in claim 17, wherein the image forming substance is a dye providing substance.

20. A heat developable light-sensitive material as claimed in claim 1, wherein the light-sensitive material further contains an auxiliary developing agent.

21. A heat developable light-sensitive material as claimed in claim 20, wherein an amount of the auxiliary developing agent is from 0.0005 to 20 times by mol based on the amount of silver.

22. A heat developable light-sensitive material as claimed in claim 1, wherein the light-sensitive material further contains a dye transfer assistant.

* * * * *